US008459245B1

(12) United States Patent
Fiorill et al.

(10) Patent No.: US 8,459,245 B1
(45) Date of Patent: Jun. 11, 2013

(54) INDUCTION DRIVE MECHANISM FOR A PAINTBALL LOADER

(71) Applicant: Budster Enterprises, LLC, Lititz, PA (US)

(72) Inventors: Michael J. Fiorill, Lancaster, PA (US); Donald Lee Kulp, Lititz, PA (US)

( * ) Notice: Subject to any disclaimer, the term of this patent is extended or adjusted under 35 U.S.C. 154(b) by 0 days.

(21) Appl. No.: 13/647,689

(22) Filed: Oct. 9, 2012

Related U.S. Application Data

(63) Continuation-in-part of application No. 12/351,386, filed on Jan. 9, 2009, now Pat. No. 8,312,871.

(51) Int. Cl.
*F41B 11/02* (2006.01)
*F41B 11/53* (2006.01)

(52) U.S. Cl.
CPC ..... *F41B 11/53* (2013.01)
USPC ..... 124/51.1; 124/82; 310/103; 310/154.02; 310/181; 310/189; 310/191; 366/219; 366/241; 366/273; 366/274; 366/279

(58) Field of Classification Search
CPC ..... F41B 11/53
USPC ..... 124/51.1, 82; 310/103, 154.02, 310/181, 189, 191; 366/219, 241, 273, 274, 366/279
See application file for complete search history.

(56) References Cited

U.S. PATENT DOCUMENTS 4,199,265 A * 4/1980 Sanderson et al. ..... 366/274
4,568,195 A * 2/1986 Herz et al. ..... 366/274
4,892,863 A * 1/1990 Agarwala ..... 505/166
5,141,327 A * 8/1992 Shiobara ..... 366/274
5,440,185 A * 8/1995 Allwine, Jr. ..... 310/156.37
5,791,325 A * 8/1998 Anderson ..... 124/56
5,816,232 A * 10/1998 Bell ..... 124/51.1
5,947,100 A * 9/1999 Anderson ..... 124/45
6,109,252 A * 8/2000 Stevens ..... 124/51.1
6,206,562 B1 * 3/2001 Eyraud et al. ..... 366/273
6,213,110 B1 * 4/2001 Christopher et al. ..... 124/51.1
6,305,367 B1 * 10/2001 Kotsiopoulos et al. ..... 124/49
6,347,621 B1 * 2/2002 Guthrie ..... 124/48
6,418,919 B1 * 7/2002 Perrone ..... 124/49
6,467,473 B1 * 10/2002 Kostiopoulos ..... 124/51.1
6,488,019 B2 * 12/2002 Kotsiopoulos ..... 124/51.1
6,502,567 B1 * 1/2003 Christopher et al. ..... 124/51.1
6,644,293 B2 * 11/2003 Jong ..... 124/52
6,701,907 B2 * 3/2004 Christopher et al. ..... 124/48
6,739,323 B2 * 5/2004 Tippmann, Jr. ..... 124/51.1
6,792,933 B2 * 9/2004 Christopher et al. ..... 124/56
6,889,680 B2 * 5/2005 Christopher et al. ..... 124/51.1

(Continued)

*Primary Examiner* — Gene Kim
*Assistant Examiner* — Alexander Niconovich
(74) *Attorney, Agent, or Firm* — Andrew D. Mead

(57) ABSTRACT

An electronically controlled, brushless DC, electromagnetic induction drive apparatus for use in a paintball marker active loader capable of directly driving the feeder element in the active loader while providing independently user selectable torque transfer capability and rotational speed whether used to continuously or intermittently rotate the loader feeder element. A plurality of selectively polarity reversible electromagnets are disposed in the loader housing and act to move a plurality of magnetic drive elements disposed on the rotating feed cone to rotate the feed cone a predetermined amount for each polarity cycle and cause paintballs to be fed into the paintball marker via a feed tube. A controller linked to the marker firing sequence manages the number and frequency of the sequential polarity changes of the electro-magnets to cause the feed cone to rotate in response to sensed movement of paintballs in the feed tube.

16 Claims, 5 Drawing Sheets

U.S. PATENT DOCUMENTS

| | | | | |
|---|---|---|---|---|
| 7,168,848 | B2 * | 1/2007 | Gigas et al. | 366/270 |
| 7,352,096 | B2 | 4/2008 | Dunn et al. | |
| 7,357,567 | B2 * | 4/2008 | Terentiev | 366/273 |
| 7,445,002 | B2 * | 11/2008 | Christopher et al. | 124/51.1 |
| 7,468,568 | B2 | 12/2008 | Naito et al. | |
| 7,481,572 | B2 * | 1/2009 | Terentiev | 366/279 |
| 7,607,424 | B2 * | 10/2009 | Monks | 124/77 |
| 7,762,716 | B2 * | 7/2010 | Terentiev et al. | 366/273 |
| 7,832,389 | B2 * | 11/2010 | Christopher | 124/51.1 |
| 7,841,328 | B2 * | 11/2010 | Italia et al. | 124/51.1 |
| 7,921,835 | B2 * | 4/2011 | Campo et al. | 124/51.1 |
| 7,948,141 | B2 * | 5/2011 | Takeuchi | 310/191 |
| 7,966,999 | B2 * | 6/2011 | Bosch et al. | 124/51.1 |
| 8,047,191 | B2 * | 11/2011 | Christopher et al. | 124/51.1 |
| 8,251,050 | B2 * | 8/2012 | Christopher et al. | 124/51.1 |
| 8,312,871 | B1 * | 11/2012 | Kulp et al. | 124/51.1 |
| 2006/0267436 | A1 * | 11/2006 | Naito et al. | 310/156.32 |
| 2007/0029889 | A1 * | 2/2007 | Dunn et al. | 310/156.43 |
| 2007/0062506 | A1 * | 3/2007 | Bell | 124/51.1 |
| 2007/0137631 | A1 * | 6/2007 | Christopher | 124/49 |
| 2009/0133680 | A1 * | 5/2009 | Christopher et al. | 124/51.1 |
| 2009/0241929 | A1 * | 10/2009 | Italia et al. | 124/51.1 |
| 2010/0206282 | A1 * | 8/2010 | Italia et al. | 124/51.1 |

* cited by examiner

INDUCTION DRIVE MECHANISM FOR A PAINTBALL LOADER

CROSS-REFERENCE TO RELATED APPLICATIONS

This application is a continuation-in-part of pending U.S. application Ser. No. 12/351,386, filed Jan. 9, 2009.

BACKGROUND OF THE INVENTION

This invention relates generally to a paintball loaders and, more particularly to an electro-magnetic induction drive mechanism for rotating a feed cone in an active feed paintball loader.

The sport of paintball war games continues to grow in popularity. During these war games, participants shoot frangible plastic balls full of a liquid dye at their opponents. The games are sometimes intensely competitive, requiring a participant to aim a gun, known also as a marker, at an opponent while pursuing, fleeing, dodging, or running for cover. Participants are excluded from further play once they have been hit and marked by a paintball. Success in the game requires the capability to fire a large number of paintballs in a short amount of time. A participant might discharge between several hundred and one thousand or more paintballs during the typical game lasting only a few minutes. Success in the game also requires player agility, which include being able to move run, dive, and roll for cover while carrying the marker.

Agitating paintball loaders are well known in the art of paintball sports, and operate by having a paintball agitator advance balls from the bottom of a loader into an outfeed tube. Active or force feeding paintball loaders are technologically advanced loaders that use powered drivers to forcibly drive paintballs from the loader, into an outfeed tube, and into the breech of a paintball marker. Examples of such loaders can be found in U.S. Pat. Nos. 6,213,110, 6,502,567, 6,701,907, and 6,792,933. As paintball loaders have evolved into electronically controlled devices capable of actively or forcibly feeding increasingly greater numbers of paintballs (at or more than 25 balls per second) into a paintball gun, the demands upon the feed apparatus in such loaders has increased accordingly.

One problem now arising in such active paintball loaders is limiting the loader feeding apparatus at times when no paintballs are being discharged from the paintball gun (zero demand from the loader). The loader drive mechanism must either temporarily suspend actuation of the feeding apparatus or risk rupturing the paintballs in the loader, the latter condition rending the paintball loader, and indeed the entire marker, effectively inoperable.

One known method for intermittently actuating the feeding mechanism is to incorporate a torsion spring into the drive apparatus for the paintball feeding mechanism and control operation of a motor drive such that it is intermittently operated in response to firing of the paintball marker. Rotation of the drive motor winds the spring which, in turn, causes the feeding mechanism to rotate when possible, such as when a paintball moves from the feeding tube into the marker's firing chamber. Such devices require complex controls to sense marker firing and manage operation of the drive motor. Additionally, once the spring is fully wound, engagement of the drive motor may cause a jammed paintball to rupture unless the torque output of the drive motor is somehow limited.

Another known method is to interpose a friction clutch between the drive motor and the feeding mechanism to limit the torque transfer to the feeding mechanism. The problem with friction devices is that torque transfer capability tends to vary as the friction surface wear. While this method might prevent unintentional paintball rupture since torque transfer is at a maximum when new friction surfaces are used and decline from that time on, the torque transfer capability will eventually become insufficient to urge paintballs from the loader to the marker as the friction materials wear. The wear time may be extended thorough use of an intermittently rotating drive motor, but such an approach requires the complicated motor controls similar to those used in the spring-based feeding mechanisms.

The above solutions are subject to breaking, wearing, or require cumbersome fixed magnet adjustments. Existing loader technologies use a traditional, brush-commutated, DC motor. This motor accepts a DC voltage causing electromagnets (much like the brushless DC design) to interact with permanent magnets. Unlike the brushless DC design, as this interaction takes place through motor rotation, components called brushes make and break connections to cause the polarity of the electromagnets to continuously cycle between positive and negative. This changing of polarity constantly pushes and pulls on the permanent magnets causing the motor to spin. Power is lost in the brushes, heat is generated from the lost power, the motor must spin at high speeds, and be reduced mechanically to produce the desired torque, and the torque is difficult to control, necessitating the mechanical components of ratio reduction and mechanical clutches.

It would therefore, be a great advantage to provide an electronically controlled drive apparatus for a paintball marker feed cone based on a brushless DC design, including micro-stepping capability, capable of providing easily manageable torque transfer capability whether used to continuously or intermittently operate the feeder mechanism. Still further advantages would be realized if the torque transfer capability of the apparatus could be selectively altered by a user to suit specific conditions, including reversing the direction of rotation to clear jams. By controlling the torque transferred through the drive mechanism, inadvertent paintball rupture can be reduced if not eliminated.

SUMMARY OF THE INVENTION

Accordingly, it is an object of the present invention to provide a drive apparatus for use in a high feed rate paintball loader incorporating a brushless DC motor design in which the polarity of a plurality of electromagnets drivers is managed by an electronic circuit such that interaction of the selective polarity stationary drive electromagnets with a plurality of ferretic driven elements disposed on a rotating paintball feeder element, by proper sequencing of the polarity of the drive magnets, allows the feeder element to be selectively rotated.

It is a further object of the present invention to provide an improved torque-limited drive apparatus for an active paintball loader that allows the loader to supply paintballs to the marker at least as rapidly as the marker's firing rate. Many modern paintball markers are capable of firing up to 25 paintballs per second. Additional advantages are provided by a drive apparatus enabling the loader feed rate to be selectively adjusted by the user It is a further object of the present invention to provide a direct drive apparatus for the feed cone in an active paintball loader that connects directly to the feed cone and eliminates the need for a reducing gear in the drive. A brushless direct current driver provides high torque to the feed cone while maintaining rotational speed much slower than that of a conventional DC motor.

It is a further object of the present invention to provide a magnetic induction based drive apparatus for use in an active paintball loader that limits the amount of torque transferred into the feeder element to an amount less than the that causing of rupture of the paintballs in the loader apparatus. A paintball rupture in the loader apparatus effectively jams the marker, generally resulting in inoperability of the loader/marker combination. Further advantages are provided by the apparatus wherein adjustment of torque and drive speed are separate and independently selectable by the user.

It is a further object of the present invention a magnetic induction drive apparatus for an active paintball loader in which a plurality of electromagnets are switched between on and off states in a controlled manner to attract and repel a plurality of permanent magnets attached to a motor shaft or a feed cone. The electromagnets may be configured for bipolar or unipolar operation; the control circuit is easily configured for operation with either.

It is a still further object of the present invention to provide a magnetic induction based drive apparatus for use in an active paintball loader that allows a user to selectively alter the amount of torque transferred into the feeder element thereby enabling the loader apparatus to be optimized for variations in paintball rupture strength. Additional advantages are provided by a drive apparatus that enables adjustment of torque independent of driver speed.

It is a still further object of the present invention to provide a torque-limiting drive apparatus for an active paintball loader that offers offering highly reliable performance. Many paintball games continue for only a few minutes during which time participants discharge thousands of paintballs. A participant with a non-functional marker is quickly "marked" and eliminated from the competition.

It is a still further object of the present invention to provide a magnetic induction-based drive apparatus for advancing the feeder element in an active paintball loader that is compatible with a variety of known active loader designs and therefore easily retrofit as an improvement to existing paintball loader designs.

It is a still further object of the present invention to provide an electronically controlled magnetic induction based drive apparatus for advancing the feeder element that monitor the torque applied to the feeder element and initiates advancement of the feeder element based on variations in that torque.

It is a still further object of the present invention to provide a torque-limiting, magnetic induction-based drive apparatus for the feeder mechanism in an active paintball loader that is durable in construction, inexpensive of manufacture, carefree of maintenance, easily assembled, and simple and effective to use.

These and other objects are achieved by the instant invention by providing an electronically controlled, brushless DC, electromagnetic induction drive apparatus for use in a paintball marker active loader capable of directly driving the feeder element in the active loader while providing independently user selectable torque transfer capability and rotational speed, whether used to continuously or intermittently rotate the loader feeder element. A plurality of selectively polarity reversible electromagnets are disposed in the loader housing and act to move a plurality of magnetic drive elements disposed on the rotating feed cone to rotate the feed cone a predetermined amount for each polarity cycle and cause paintballs to be fed into the paintball marker via a feed tube. A controller linked to the marker firing sequence manages the number and frequency of the sequential polarity changes of the electro-magnets to cause the feed cone to rotate in response to sensed movement of paintballs in the feed tube.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Various components shown or described herein for any specific application of this invention can be varied or altered as anticipated by this invention and the practice of a specific application of any element may already by widely known or used in the art by persons skilled in the art and each will likewise not therefore be discussed in significant detail. When referring to the figures, like parts are numbered the same in all of the figures.

Figure 1:
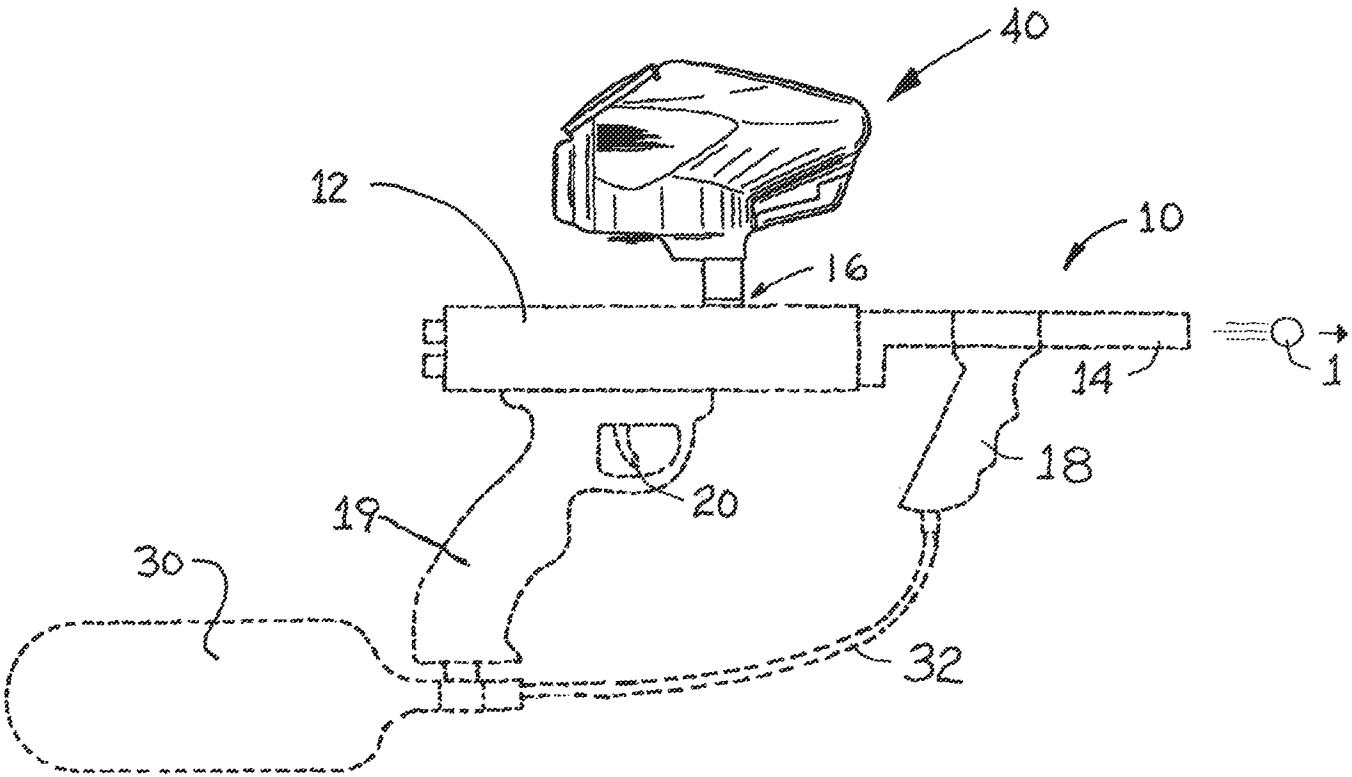
FIG. 1 shows a side view of a typical paintball marker and active loader of the type on which the present invention proves useful.

FIG. 1 shows a side elevation view of a typical paintball marker 10, illustrated in phantom, having an attached active feed loader 40 of the type in which the present invention is useful. Paintball marker 10 is a pneumatically-operated gun for discharging paintballs and is well-known in the art. Paintball marker 10 includes a main body 12, a barrel 14, a compressed gas supply cylinder 30, a front handgrip 18, and a rear handgrip 19. The front handgrip 18 projects downwardly from the barrel 14 and, along with rear handgrip 19, provide areas for gripping by an operator of the paintball marker 10. Paintball marker 10 also includes an inlet opening 16 leading to a firing chamber (not shown) in the interior of the main body 12 and a trigger 20. The firing chamber also opens to barrel 14 through which projectiles, paintballs 1, are propelled. The compressed gas cylinder 30 is typically secured to a rear portion of the paintball marker 10. Compressed gas is supplied to the marker via a pressure regulator (not shown) by gas supply line 32. The compressed gas cylinder 30 normally contains compressed carbon dioxide ($CO_2$), although any compressed gas may be used.

Operation of marker 10 is selectively controlled by trigger 20 which directs the admission of compressed gas, supplied by storage cylinder 30 via gas supply line 32, to a marker firing control apparatus (not shown) for a firing mechanism. The marker firing control apparatus coordinates pressurized gas supply to mechanisms with the marker to fire, reload, and prepare the marker to fire again. The bursts of gas are used to eject paintballs outwardly through the barrel 14 by operation of a firing mechanism. After firing, compressed gas is used to reposition a bolt in the firing chamber to open inlet opening 16 thereby allowing another projectile to be loaded into the firing chamber from the loader 40. Compressed gas is then used to re-position the bolt so that the marker is ready to fire the projectile in response to a pull of the trigger 20. The paintballs are continually fed by the paintball loader 40 through the inlet tube 16 to the firing chamber.

Figure 2:
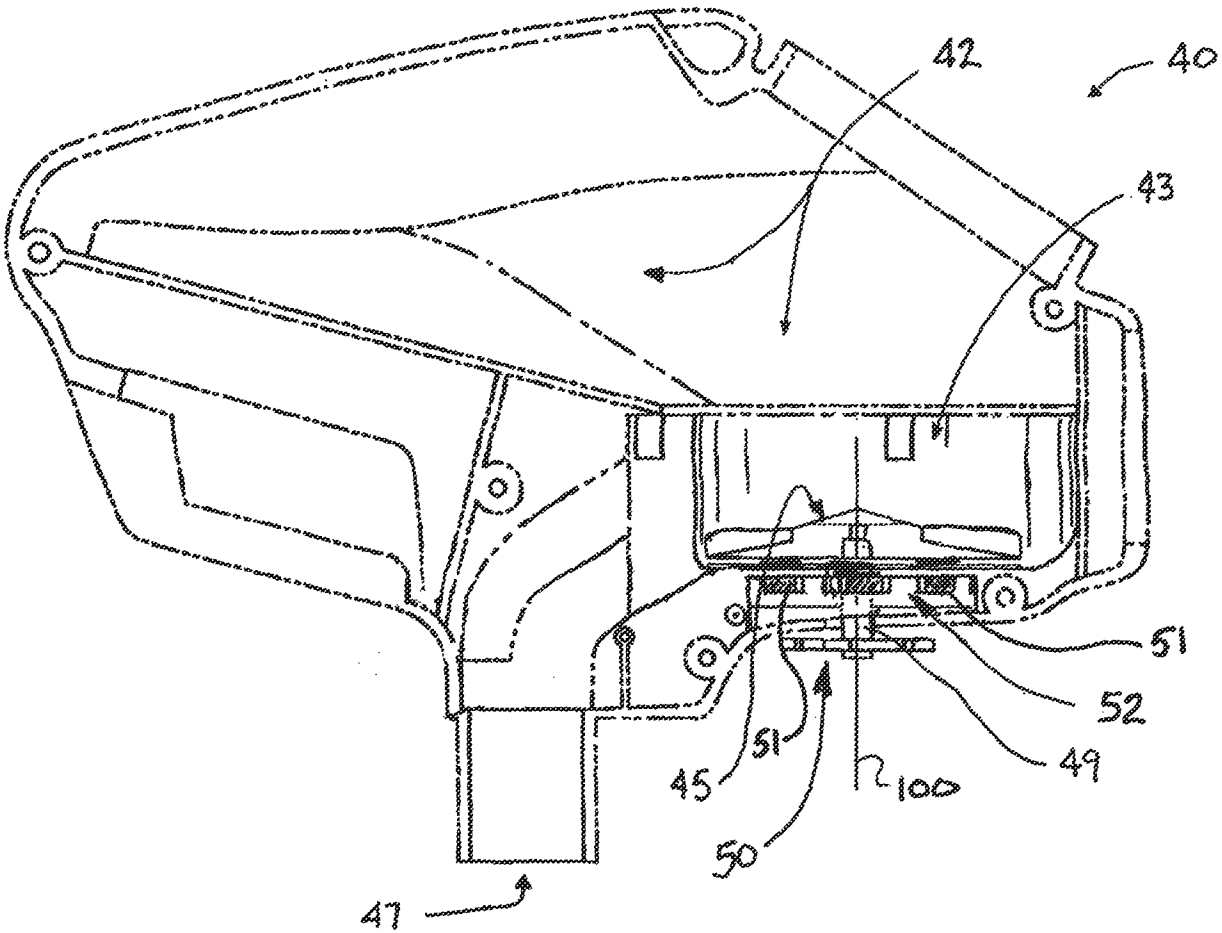
FIG. 2 shows a partial side view of a paintball loader and the location of one embodiment of the magnetic induction drive of the present invention.
Figure 3:
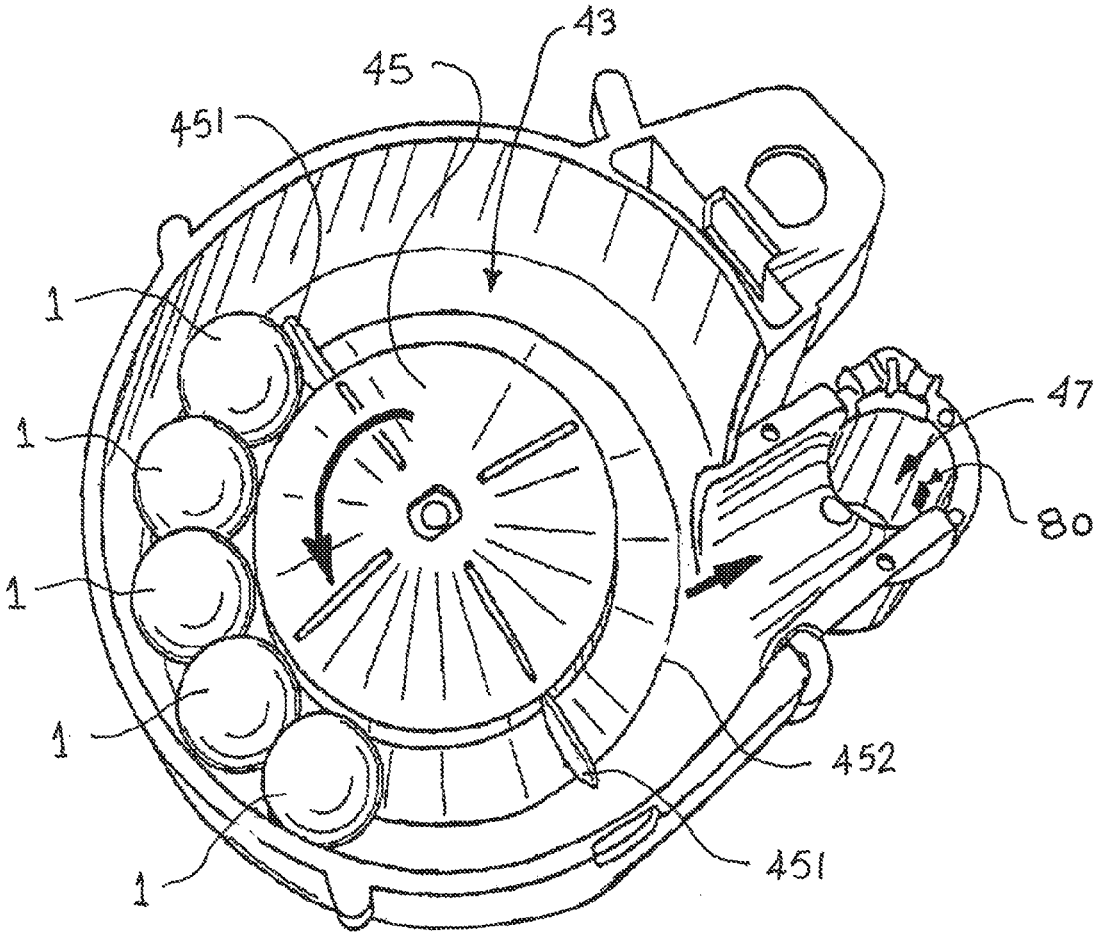
FIG. 3 shows a partial view of the lower section of the loader housing and the rotating feed cone.

Now referring to FIGS. 2 and 3 wherein one embodiment of the active feed loader 40 is presented comprising a paintball container (or hopper) 42 with a rotatable feed cone 45 disposed in the lower portion 43 of the hopper, and an outfeed tube 47 for supplying paintballs from the loader 40 to the marker inlet opening. The feed cone 45 may comprise one or more paddles 451 disposed along the periphery 452 of the feed cone which interact with the paintballs to impel the paintballs toward the outfeed tube 47 as the feed cone rotates. Feed cone 45 is rotatably mounted on a shaft 49 aligned along a rotational axis 100. Rotation of the feed cone 45 may be accomplished by fixing the cone 45 to rotation simultaneous with rotation of the shaft or by configuring the shaft to serve as an axle which constrains movement of the cone to rotation.

Active feed paintball loaders are well-known in the art and described in detail in U.S. Pat. No. 6,213,110, "Rapid Feed Paintball Loader," and U.S. Pat. No. 6,502,567, "Rapid Feed Paintball Loader With Pivotable Deflector," the entire contents of which are each incorporated herein by reference.

The present drive apparatus 50 also comprises a drive platform 52 which is fixed to the loader 40 and a rotor 62 configured for rotatation about rotational axis 100. A plurality of electromagnetic drive members 51 are connected to platform 52 and arranged in a generally circular arrangement about the periphery of rotor 62. Drive members 51 remain fixed with respect to the drive platform 52 which also fixes their angular position about axis 100. Alternatively, drive platform 52 may be integral to the loader housing. The rotor 62 comprises a plurality of driven elements 60 symmetrically arranged about the circumferential periphery of the rotor, the plurality of driven elements being further divided between a first plurality of driven elements 60P having a first polarity and a second plurality of driven elements 60N having a second polarity, opposite of the first polarity, the driven elements being arranged about the rotor periphery alternating between the first and second polarities. This pole arrangement is best accomplished through the use of permanent magnets arranged with alternating positive and negative (or north and south) polarity around the periphery of the rotor.

Figure 4:
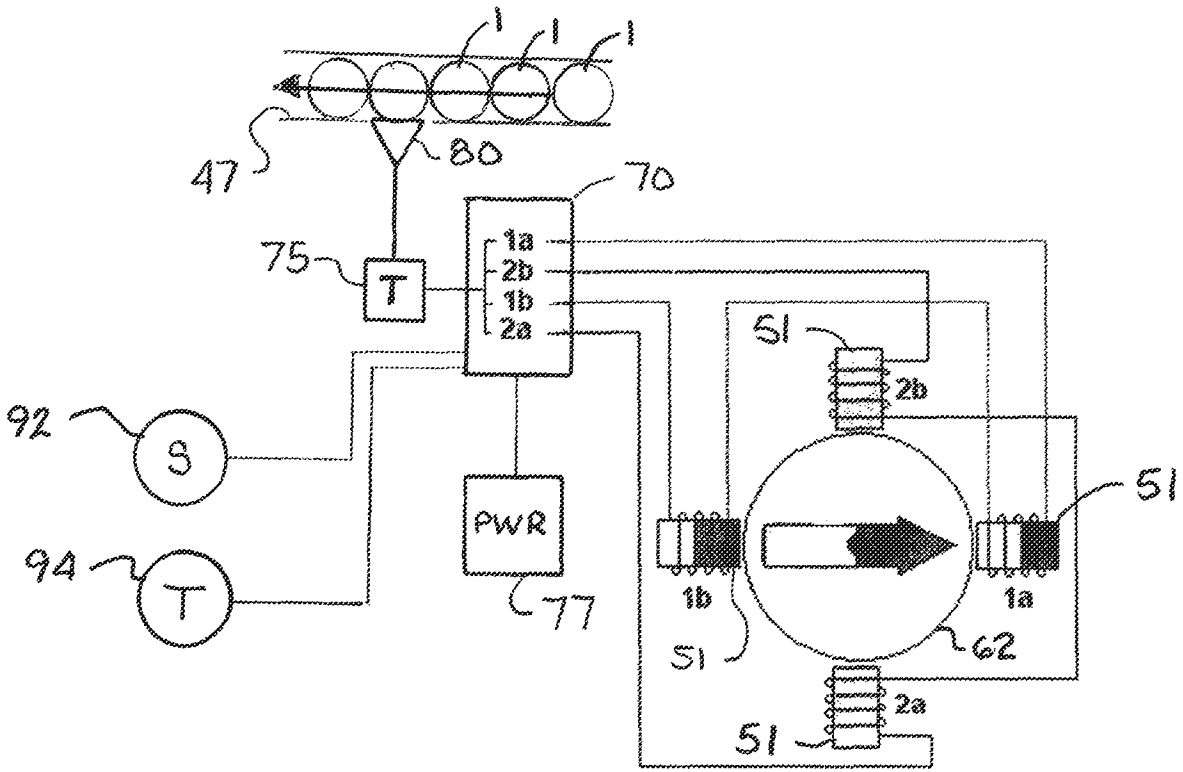
FIG. 4 is a diagrammatic view of a stepper motor and controller as used in the present invention.
Figure 5:
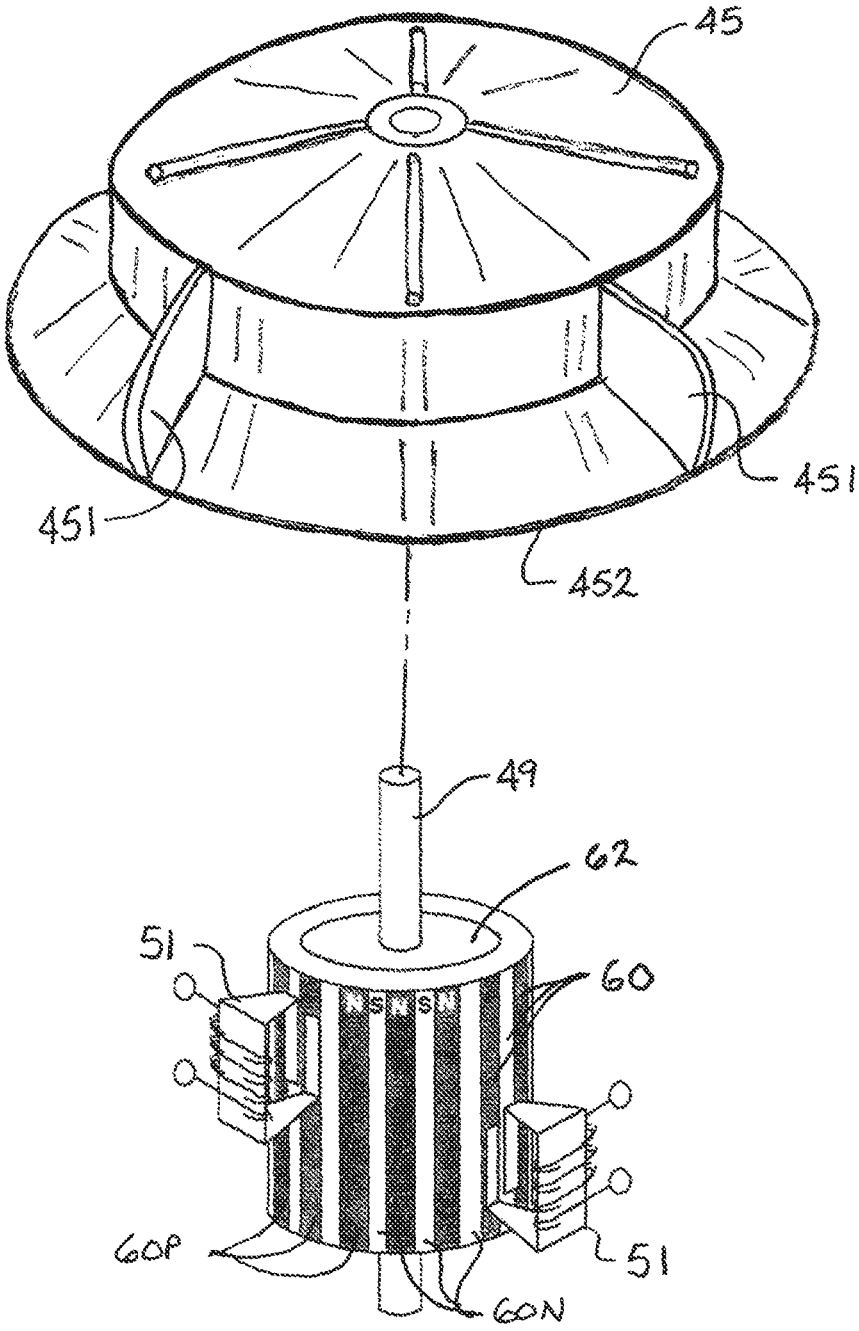
FIG. 5 is a diagrammatic view of the driven element of the stepper motor and feed cone illustrating the magnet arrangement of driven element and the relationship of the electromagnetic driver elements thereto.

FIGS. 3 and 4 provide a detailed view of the drive apparatus illustrating the relationship between the drive platform 50 and the feed cone 45. The present invention design employs a brushless DC (BLDC) design, sometimes called a stepper motor. Rather than using brushes to commutate the DC polarity to the electromagnet drive elements 51, electronic circuitry in controller 70 manages the polarity of the drive elements 51 and hence the driving magnetic forces directed to the motor. This approach has specific advantages when the motor drive shaft 49 is connected directly to the feed cone 45. The present invention uses interactions between driven elements and electromagnetic drive elements in the motor to create a fully electronic clutching mechanism that can be easily adjusted electronically, directly connected to the feed cone, and eliminate mechanical clutching by replacing it with an induction drive.

The brushless DC (BLDC) induction drive apparatus 50 is pulse driven by electrical pulses managed by controller 70. As a result, the rotational speed of the BLDC motor may be precisely controlled by the rate of pulses directed from the electronic controller 70 to the BLDC motor drive elements 51. This allows for exact regulation of feed cone 45 rotational speed and precise setting to competition specifications. A BLDC motor design also offers higher torque levels at low rotational speed, especially the speed typically desired for feeder cone rotation. Increased torque capability of the BLDC design enables a direct coupling between the driver and the feeder cone eliminating the need for a gearbox, pulley system, or other drive ratio reduction system between the motor drive and the feed cone. Elimination of these sub systems eliminates related failure mechanisms and reduces the size and complexity of the feed cone drive system.

Drive platform 52 comprises a plurality of electromagnetic drive members 51 each fixedly connected to platform 52 and arranged about rotational axis 100. The drive members 51 are switched between two opposing states in a manner to attract and repel the driven elements 60, preferably permanent magnets that affixed on a rotor 62 which is connected to shaft 49. The controller 70 applies alternating polarity to each drive member 51 with the alternating polarity sequenced to push and pull the driven elements 60 in a specific direction causing the rotor 62 and shaft 49 to rotate. This is commonly referred to as a bi-polar stepper drive. Controller 70 may also be configured to a simpler unipolar drive arrangement in which the drive element sequencing is configured to push or pull the driven elements, but not both simultaneously. The bi-polar arrangement is preferred as it offers significantly greater drive torque. Unipolar drive arrangements are less costly due to simplified electronics in the controller and thus advantageous in more price-sensitive loader applications.

The controller and the electro-magnetic drive elements are powered by an on-board power supply 80, typically a 9-volt battery, which is already common in the paintball marker/active loader designs available in the market. Other power supply means for the control circuit are contemplated within the scope of the invention.

The number of driven members 60 and electro-magnetic drive members 51 determine the angular advancement of the drive cone 45 for each energized/de-energized cycle of the drive members 51 and hence may influence both the rate of feed cone rotation and the torque transfer into the feed cone. Additionally, the relative position of the drive members 51 around the rotor also influences the angular step size. Micro-stepping, while not a requirement for system functionality, has been demonstrated to reduce noise in the paintball feed system. Commonly available BLDC motors are configured with 1.8 degree (200 poles or driven members 60) or 7.2 degree (50 poles or driven members 60) detents. A step pulse causes the motor to rotationally advance by one detent. Therefore, when using a 200 pole motor, 200 step pulses results in one revolution of the feed cone. Micro-stepping breaks each step pulse into a series of smaller steps allowing smaller incremental advancement of the feed cone. Micro-stepping allows smoother advancement of the feed cone and reduces harmonic oscillations throughout the mechanical components of the paintball feed system. Although variable, the preferred embodiment of controller 70 uses ⅛-step micro-stepping resulting in 1,600 or 400 distinct feed cone positions per feed cone rotation using the 200 and 50 pole stepper motors, respectively.

By precisely controlling the degree of rotation of the feed cone 45 for each paintball demand cycle, the controller 70 precisely delivers a quantity of paintballs to the paintball marker inlet 16 that matches the demand by the marker. Precise control of the loader drive mechanism 50 lowers run time of the driver thereby reducing power consumption (resulting in longer battery life) and system noise. A sensor 80, which is in one embodiment positioned in the loader feed tube 47, identifies a paintball demand by the paintball marker and directs an input to a triggering device 75. The sensor 80 and triggering device are provided to quiet loader operation and reduce the energy demand by the drive apparatus 50 thus further extending battery life. A preferred sensor 80 is a touch-based flex sensor positioned in the feed tube 47 capable of detecting the passing of each paintball past the sensor. Other sensor types, such as optical, acoustic or other mechanical configurations are also contemplated. The triggering device initiates action in the controller 70 to produce the required outputs (steps or micro-steps) to the driver elements 51 to cause the required rotation of the feed cone needed to advance one paintball into the marker firing chamber via the feed tube 47 to the inlet opening 16. For each paintball fired by the marker, the controller 70 rotates the feed cone 45 the number of steps or micro-steps correlating to the delivery of one paintball by the feed cone according to the following relationship:

(steps/revolution)*(micro-steps/step)/(paintballs delivered/revolution)

A small overrun rotation may be provided in the calculation to provide better continuity of feed cone rotation during the successive paintball demand cycles. Understepping will result in an incomplete pass of the paintball feed cone past the feed tube opening which can cause problems with paintball delivery. As non-integral step (or micro-step) values in the controller are impossible to execute in the BLDC driver, the overrun function works with a ceiling function to that rounds non-integral computational results to the next highest integral value.

Upon receipt of the triggering event from the sensor 80 and triggering device 75, the controller 70 intermittently directs current pulses to the drive members 51 in a sequential pattern to cause rotation of the feeder cone 45, creating a magnetic stepper drive wherein the stepping function is initiated by a triggering event. The controller 70 also allows the feed rate of paintballs to be precisely regulated. The rate of feed cone rotation is determined by the number of stepper pulses applied per unit of time. Unlike traditional DC drive motors, rotational speed does not vary with voltage. A user can specify a desired feed rate (paintballs per second) using a feed rate input device 92 and the controller will use the desired feed rate to determine the rate that steps or micro-steps are to be applied to the feed cone driver. Moreover, the desire feed rate is implemented by the calculations within the controller and does not require complicated and more failure-prone devices for varying the input voltage as would be necessary using a conventional DC drive motor.

The unique characteristics of a BLDC motor allow torque generated by the drive elements 51 to be precisely managed and limited, effectively limiting the force exerted on the paintballs by the feed cone 45. The torque adjustment is separate and independent of the feed rate adjustment described above. Torque applied to the feed cone is proportional to the amount of current supplied to the drive elements. The controller is configured to deliver a constant current (instead of constant voltage) to the drive elements using a chopper circuit. The current limit can be selected by a user, typically using an input potentiometer 94 or the like. By properly selecting the value of this torque limit, the present invention may be configured to rotate the feed cone and deliver paintballs at a desired rate (established by the steps per unit time) when paintballs are being fired by the marker, but cease rotation by stalling (torque limited) when the consumption slows, or ceases (for example the paintball gun not being fired) or when a paintball jam occurs in the feed tube. As a result, the loader 40 may be configured to function without sensor 80 and triggering device 75. In this embodiment, the controller 70 can direct the drive apparatus 50 to continuously step while the torque threshold is set to a value that causes the feed cone to stall during periods of no paintball demand without rupturing the paintballs. The capability to control the driver to provide a rotating torque to the feed cone sufficient to drive paintballs into the marker, yet which will stall when the input torque exceeds a pre-determined threshold enables the loader drive apparatus 50 to avoid rupturing paintballs in the loader when jams occur. This capability also allows an initial priming routine to be executed by the controller upon initial activation to fill feed tube 47 with paintballs. The capability may also be used as a fail-safe mode of operation in the event of a fault in the sensor 80 or triggering device 75, allowing the loader 40 to continue feeding paintballs to the marker 10.

Precision control of torque and speed to the feed cone 45 provides the advantages of a clutch mechanism in the feed cone drive without a dedicated clutch device. The result is a drive apparatus 50 for an active paintball loader that provides improved performance with a simpler and less complex mechanism.

Although the invention has been described in connection with specific examples and embodiments, those skilled in the art will recognize that the present invention is capable of other variations and modifications within the scope of the invention but beyond those described herein. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention as presented in the following claims.

Having thus described the invention, what is claimed is:

1. An active paintball loader for use with a paintball marker, said loader operably connected to said marker and comprising:

a hopper for containing paintballs;

a feed tube for conveying paintballs from said hopper to the marker;

a feed cone disposed within said hopper rotatable about an axis fixed in relation to said hopper, said feed cone configured for urging by rotation thereof paintballs from said hopper into said feed tube;

a drive mechanism for rotating said feed cone, said drive mechanism further comprising:

a rotor arranged for rotation about said axis, said rotor having a plurality of first magnetic driven elements and a plurality of second magnetic driven elements symmetrically, alternatingly spaced around a generally cylindrical circumferential periphery about said axis, said plurality of first magnetic driven elements having a polarity opposite to said plurality of second magnetic driven elements;

a plurality of electro-magnetic drive elements connected to the loader, said plurality of electro-magnetic drive elements being switchable between first and second states; and a controller for managing said states of each of said plurality of electro-magnetic drive elements, said controller configured to sequentially switch said state of each of said plurality of electro-magnetic drive elements between said first and second states in a manner to cause rotation of the feed cone thereby urging paintballs from the hopper into the feed tube.

2. The paintball loader of claim 1, further comprising an input trigger for initiating action of said drive mechanism, said controller upon receipt of an input signal from said input trigger initiating a pre-determined number of switches of states in at least one of said plurality of electro-magnetic drive elements thereby causing a predetermined angular rotation of said feed cone.

3. The paintball loader of claim 2, wherein said predetermined angular rotation is at least sufficient to urge a paintball into the marker via said feed tube.

4. The paintball loader of claim 2, wherein said input trigger is an optical sensor disposed in said feed tube.

5. The paintball loader of claim 2, further comprising a feed rate selector configured to initiate and communicate a desired feed rate signal to said controller, said controller upon receipt of said feed rate signal determining a drive frequency at which to switch states of at least one of said plurality of electro-magnetic drive elements.

6. The paintball loader of claim 5, further comprising a desired torque selector configured to initiate and communicate a torque input signal to said controller, said controller upon receipt of said torque input signal determining an electrical current value and providing said electrical current value to at least one of said plurality of drive elements.

7. The paintball loader of claim 6, wherein said controller further comprises a chopper circuit configured to provide a constant current to each of said electro-magnetic drive members when in said first state.

8. An active paintball loader for use with a paintball marker, and a rotatable feed cone for urging paintballs from the hopper to the feed tube, said drive mechanism comprising:

a hopper for containing paintballs;

a feed tube for conveying paintballs from the hopper to the marker;

a feed cone disposed within said hopper rotatable about an axis fixed in relation to said hopper, said feed cone configured for urging by rotation thereof paintballs from said hopper into said feed tube;

a driver mechanism having a plurality of electro-magnetic drive elements and plurality of magnetic driven elements, said plurality of magnetic driven elements being symmetrically, alternatingly spaced around a generally cylindrical circumferential periphery about said axis, said plurality of electro-magnetic drive elements being positioned adjacent to said periphery and switchable between first and second states, alternating between said first state and said second state causing said driver mechanism to rotate a predetermined angular displacement;

an input mechanism for initiating action of said driver mechanism; and a controller for managing said state of each of said plurality of electro-magnetic drive elements responsive to said input mechanism, said controller configured to sequentially switch said state of each of said plurality of electro-magnetic drive elements between said first and second states in a manner to cause rotation of the feed cone by an angular feed rotation thereby urging paintballs from the hopper into the feed tube.

9. The paintball loader of claim 8, wherein said angular feed rotation is at least sufficient to urge a paintball into the marker via said feed tube.

10. The paintball loader of claim 8, wherein said input mechanism is an optical sensor disposed in said feed tube.

11. The paintball loader of claim 8, further comprising a feed rate selector configured to initiate and communicate a desired feed rate signal to said controller, said controller upon receipt of said feed rate signal determining a drive frequency at which to switch states of at least one of said plurality of electro-magnetic drive elements.

12. The paintball loader of claim 11, further comprising a desired torque selector configured to initiate and communicate a torque input signal to said controller, said controller upon receipt of said torque input signal determining an electrical current value and providing said electrical current value to at least one of said plurality of drive elements.

13. The paintball loader of claim 12, wherein said controller further comprises a chopper circuit configured to maintain said electric current value directed to each of said electro-magnetic drive members when in said first state generally constant.

14. A method for feeding paintballs from an active loader to a paintball marker comprising the steps:

providing a feed cone disposed within a paintball hopper, the feed cone rotatable about an axis fixed in relation to the hopper, the feed cone configured for urging by rotation thereof paintballs from the hopper to the marker;

providing a stepper driver mechanism having a plurality of magnetic driven elements symmetrically, alternatingly spaced around a generally cylindrical circumferential periphery about the axis, and a plurality of electro-magnetic drive elements positioned adjacent to the periphery and switchable between first and second states, cycling of each of the electro-magnetic drive elements between said first and second states causing the drive mechanism to rotate a pre-determined angular displacement step;

providing an input mechanism for initiating action of the driver mechanism;

providing a controller for managing the state of each of the plurality of electro-magnetic drive elements responsive to the input mechanism, the controller configured to sequentially switch the state of each of the plurality of electro-magnetic drive elements between the first and second states in a manner to cause rotation of the feed cone by a one or more angular steps thereby urging paintballs from the hopper into the feed tube;

initiating by the input mechanism action of the driver mechanism;

determining by the controller a required number of angular displacement steps needed rotate the feed cone sufficiently to urge a paintball into the marker; and sequentially switching by the controller the state of each of the plurality of electro-magnetic drive elements between the first and second states causing the driver mechanism to rotate an angular displacement step with each switch cycle and continuing sequential switching until the required angular displacement of the feed cone is reached.

15. The method of claim 14, further comprising the steps of:

providing a feed rate selector configured to initiate and communicate a desired feed rate signal to the controller;

determining by the controller a drive frequency at which to switch states of at least one of the plurality of electro-magnetic drive elements in response to the feed rate signal; and sequentially switching by the controller the state of each of the plurality of electro-magnetic drive elements between the first and second states at the drive frequency.

16. The method of claim 15, further comprising the steps of:

providing a desired torque selector configured to initiate and communicate a torque input signal to the controller;

determining by the controller upon receipt of the torque input signal an electrical current value for at least one of the plurality of electro-magnetic drive elements; and providing the electrical current value to at least one of the plurality of drive elements.

* * * * *